United States Patent [19]

Foster

[11] Patent Number: 4,723,422

[45] Date of Patent: Feb. 9, 1988

[54] NECKTIE SIMULATING BROOCH

[76] Inventor: Elaine Foster, 35 E. Ninth St., Apt. 33, New York, N.Y. 10003

[21] Appl. No.: 901,443

[22] Filed: Aug. 28, 1986

[51] Int. Cl.[4] ..... A41D 25/00

[52] U.S. Cl. ..... 63/20; 2/145; D11/202; D11/75; 24/49 CP; 63/2

[58] Field of Search ..... 63/20; 2/144, 145, 148, 2/150, 151, 152, 149; D11/48, 75; D2/605, 354; 24/49 TS, 49 S, 49 P, 49 CP, 49 C, 49 R, 49 KC, 49 M

[56] References Cited

U.S. PATENT DOCUMENTS

| | | | |
|---|---|---|---|
| D. 232,986 | 10/1974 | Beck | 2/144 |
| D. 270,781 | 10/1983 | Filmer | D11/75 |
| D. 277,617 | 2/1985 | Chen | D2/605 |
| 2,466,131 | 4/1949 | Taborski | 2/151 |
| 2,553,437 | 5/1951 | Burke | 2/150 |
| 2,642,572 | 6/1953 | Tobias | 2/150 |
| 3,639,916 | 2/1972 | Vaughn | 2/145 |
| 4,546,494 | 10/1985 | Garber | 2/150 |
| 4,627,113 | 12/1986 | Lord | 2/144 |

FOREIGN PATENT DOCUMENTS

| | | | |
|---|---|---|---|
| 537182 | 4/1955 | Belgium | 2/150 |

*Primary Examiner*—Richard J. Johnson
*Attorney, Agent, or Firm*—Blodgett & Blodgett

[57] ABSTRACT

A fabricated brooch of rigid sheet material having the general appearance of a man's necktie and comprising a head portion, a tail portion which is attached to the head portion, and releasable fastening means connected to the head portion for releasably attaching the brooch to the collar of a shirt, blouse or other garmet.

7 Claims, 8 Drawing Figures

NECKTIE SIMULATING BROOCH

BACKGROUND OF THE INVENTION

The present invention is generally directed to a fabricated jewelry item and is directed more specifically to a brooch which is fabricated from rigid sheet material such as sheet metal.

In the art of jewelry fabrication, the primary goal in producing a jewelry item is to make the item aesthetically pleasing or attractive. The jewelry must also be worn which means that one or more elements of the jewelry are primarily functional in nature. These functional elements are important to ensure that the jewelry item is worn properly when attached to an item of clothing, remains intact and maintains its attaching function for an extended period of use. If too little attention is paid to the functional aspects of a fabricated jewelry item, the item either comes apart or becomes unattached from clothing after a relatively short period of use. On the other hand, if too much emphasis is placed on functional features, these features detract from the attractiveness of the jewelry item. These and other difficulties experienced with prior art fabricated jewelry items have been obviated by the present invention.

It is, therefore, a principle object of the invention to provide a fabricated brooch which is aesthetically pleasant and which is capable of a long life of useful service.

Another object of this invention is the provision of a fabricated brooch which has aesthetic and functional features which do not adversely affect each other.

A further object of the present invention is the provision of a fabricated brooch which has aesthetic and functional features which enhance each other.

It is another object of the present invention to provide a fabricated brooch which has the outer appearance of a man's-knotted necktie in which several of the aesthetic details of the brooch which create the illusion of a tie also have functional qualities which do not detract from the aesthetic appeal of the brooch.

With these and other objects in view, as will be apparent to those skilled in the art, the invention resides in the combination of parts set forth in the specification covered by the claims appended hereto.

SUMMARY OF THE INVENTION

The invention consists of a brooch fabricated of rigid sheet material which comprises a curved head portion which has the general appearance of the knot of a man's necktie, a tail portion which is attached to the head portion and which has the general appearance of the downwardly extending portion of a man's necktie, and releasable fastening means connected to the head portion for releasably attaching the brooch to the collar of a shirt, blouse or other garmet. More specifically, the top edge of the tail portion which adjoins the bottom inside edge of the head portion, is fashioned so as to project out in the center, curve in one both sides of the central projection and then flare forward slightly at each other edge in order to create the illusion of what occurs when a flat tie material takes on a three-dimensional knotted quality, as in a man's knotted necktie and to put the three areas in contact in a way that provides for secure soldering together of the head and tail portion.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
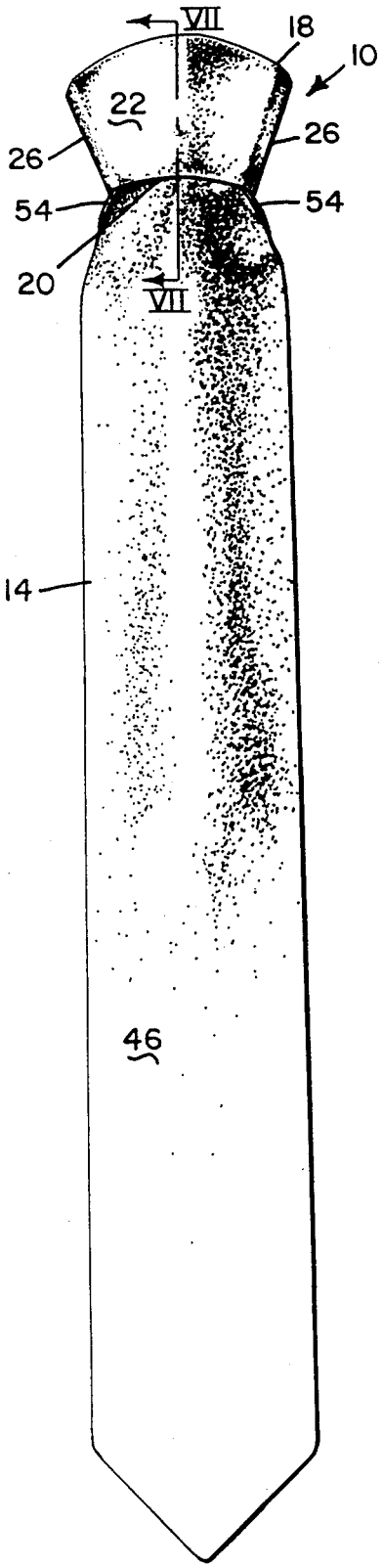
FIG. 1 is a front elevational view of a brooch embodying the principles of the present invention.
Figure 2:
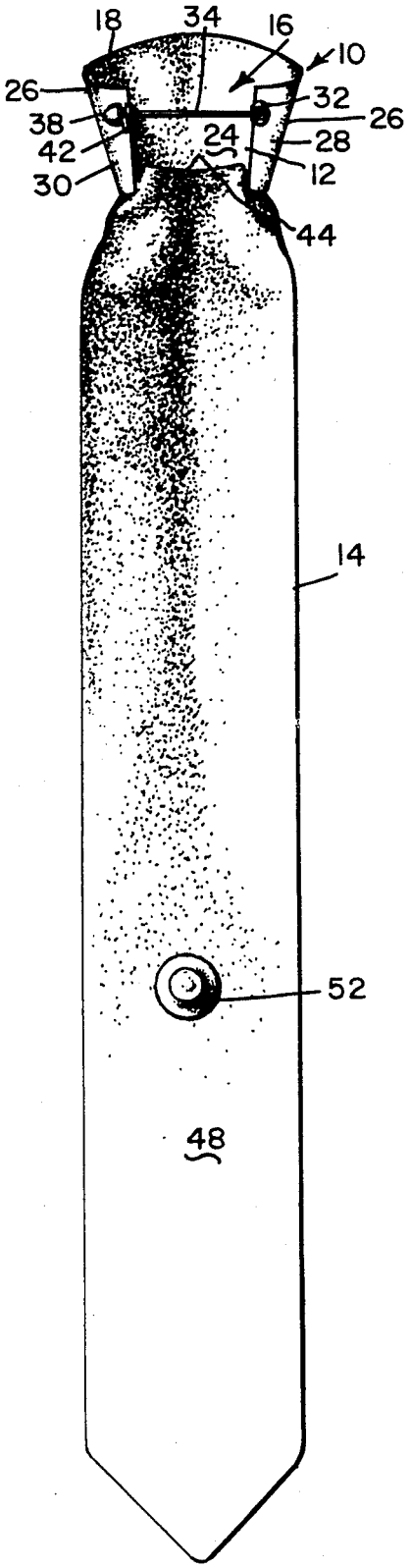
FIG. 2 is a rear elevational view of the brooch.

Referring first to FIGS. 1 and 2, a tie brooch embodying the general features of the present invention is generally indicated by the reference numeral 10 and has the general outward appearance of a man's-knotted necktie. The brooch 10 comprises a head portion 12, a tail portion 14, and releasable fastening means, generally indicated by the reference numeral 16.

The head portion 12 is formed from a rigid planar sheet material, such as gold or silver sheet metal or other rigid material which is curved out and formed in such a manner as to give the general appearance of the knot portion of a man's necktie. The head portion 12 comprises a top edge 18, a bottom edge 20, a front broad surface 22, and a rear broad surface 24. The front broad surface 22 is convex in a horizontal direction. The sides of the head portion 12 are folded back to form pair of inwardly directed flanges 28 and 30 which are fashioned from the ends of the broad surface 22, creating a pair of opposite rounded side edges 26. The flanges 28 and 30 are spaced from the rear broad surface 24 and constitute support means for the releasable fastening means 16. The releasable fastening means 16 includes a joint 32 which is fixed to the flange 28 and a catch 38 which is fixed to the flange 30. An elongated pin 34 is pivotally connected to the joint 32 by means of a pivot pin 36 illustrated in FIGS. 5 and 6 for movement about a generally vertical axis. The catch 38 includes a slot 40 illustrated in FIG. 3, for receiving the free end of the pin 34 and a safety catch 42 for retaining the end of the pin 6 in the slot 40, all illustrated in FIG. 3. The releasable fastening means 16 is the type of fastening means normally used on jewelry for brooches, pins, metals, eth.

Figure 4:
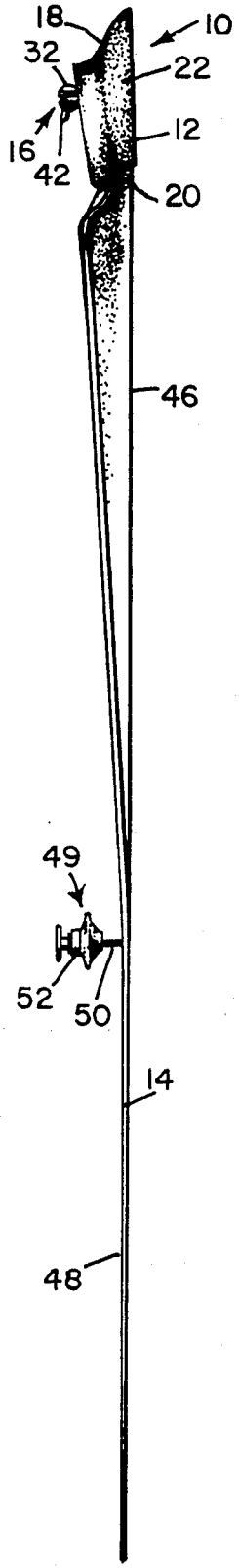
FIG. 4 is a left hand elevational view of the brooch.
Figure 5:
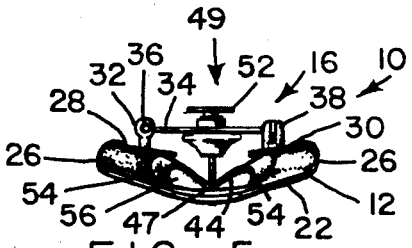
FIG. 5 is a top plan view of the brooch.
Figure 6:
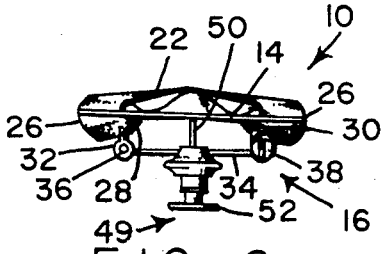
FIG. 6 is a bottom plan view of the brooch.
Figure 7:
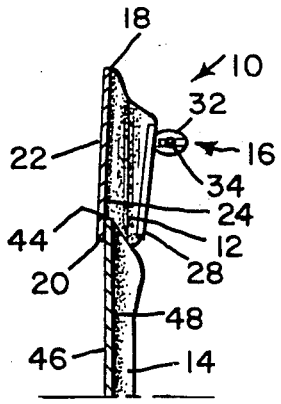
FIG. 7 is a vertical cross-sectional view of the brooch taken on the line VII—VII of FIG. 1.

The tail portion 14 has a top edge 44, a front broad surface 46, and a rear broad surface 48 all illustrated in FIG. 7. The bottom portion of the tail 14 is flat and gradually curves from side to side beginning half way up the tail portion. The upper outer surface 46 is convex in the center concave on either side of the central portion and flares forward slightly at the outer edges from side to side and the radius of curvature of the surface 46 is substantially less than the radius of curvature of the outer surface 22 of the head portion 22 where the tail portion 14 joins the head portion 12. The head portion 12 and the tail portion 14 overlap slightly so that the upper edge 44 of the tail portion is inside and above the lower edge 20 of the head portion as shown in FIG. 7. Because of the differences in curvature between the tail portion 14 and the head portion 12 at the point of overlap, the front surface 46 of the tail portion joins the lower rear broad surface 24 in FIG. 7 of the head portion at a midpoint 47 on its lower edge between the side edges 26 of the head portion as shown in FIG. 5. The side ends of the tail portion 14 curve forward at 54 adjacent the head portion 12 as illustrated in FIGS. 4 and 5 so that they engage the rear braod surface 24 just behind the flanges 28 and 30 so that a vertical opening 56 is formed between the outer surface 46 of the tail portion and the rear surface 24 of the head portion and between the midpoint 47 and each curved end 54. The tail portion 14 is joined to the head portion 12 by soldering at the midpoint 47 and where the curved ends 54 engage rear broad surface 24. The difference in curvature between the head and tail portions of the brooch where the tail portion joins the head portion and the resulting spaces 56 on opposite sides of the midpoint 47 create the illustion of the man's necktie in the area of the knot of the necktie. The curved ends 54 of the tail portion further enhance the illusion of a man's necktie while at the same time forming contact points with the rear broad surface 24 so that the tail portion 14 can be fixed securely to the head portion 12. The flanges 28 and 30 shield the curved ends 54 and also support the catch 38 and joint 32 of the fastening means 16. Since the catch 38 and the joint 32 are spaced from the surface 24, the fastening means 16 is located substantially rearward of the front broad surface 22 of the head portion 12. When the fastening means 16 is attached to the collar of the wearer, the brooch extends sufficiently forward of the collar as would a man's necktie.

Figure 3:
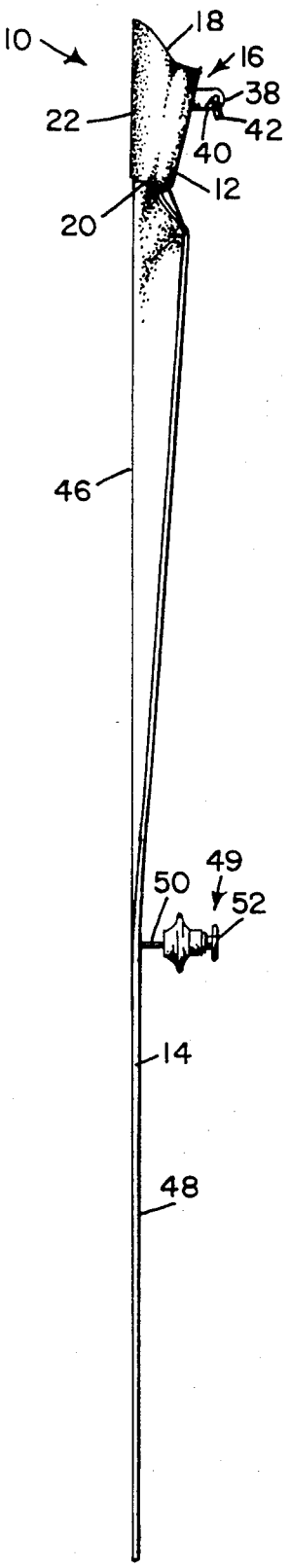
FIG. 3 is a right hand elevational view of the brooch.

The brooch 10 is also provided with a tie tack which is generally indicated by the reference numeral 49 in FIGS. 3 and 4. The tie tack 49 includes a post/pin 50 which is fixed to and extends rearwardly of the rear broad surface 48 of the tail portion 14. The post/pin 50 is adapted to be releasably engaged by a standard tie tack clasp 52 and goes through the clothing with the clutch of the tie tack affixed to the head of the post/pin.

MODIFIED BROOCH

Figure 8:
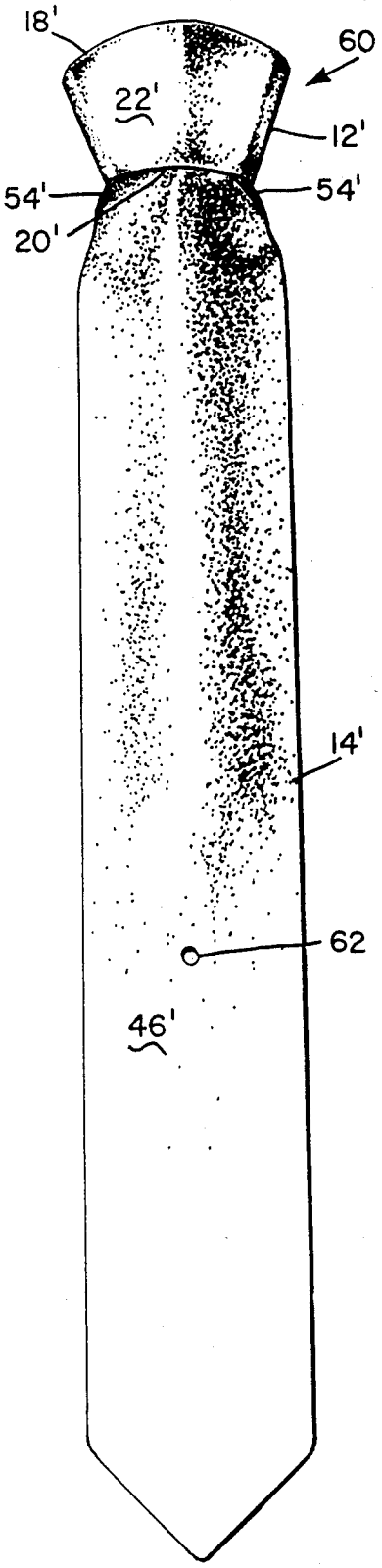
FIG. 8 is a front elevational view of a brooch showing a modification.

Referring to FIG. 8, there is shown a modified brooch which is generally indicated by the reference numeral 60. The brooch 60 is identical to the brooch 10 in every way except that it does not include a tie tack, such as the tie tack 49 of the preferred embodiment. The brooch 60 includes a head portion 12' and a tail portion 14'. The head portion 12' includes a bottom edge 20', a top edge 18', and a front braod surface 22'. The tail portion 14' includes a front broad surface 46' and forwardly curved ends 54' adjacent the bottom of the head portion 12'. The tail portion 14' also includes an aperture 62 for receiving the post/pin of a conventional tie tack to which may be attached decorative emblems.

It is obvious that minor changes may be made in the form and construction of the invention without departing from the material spirit thereof. It is, however, desired to confine the invention to the exact form herein shown and described, but it is desired to include all such as properly come within the scope claimed.

The invention having been thus described, what is claimed as new and desired to secure by Letters Patent is:

1. A brooch comprising:

(a) a generally vertical head portion of rigid sheet material having a front broad surface, a rear broad surface, a top edge, a bottom edge, a pair of rounded opposite side edges which extend from the bottom edge to the top edge and a pair of flanges which extend inwardly from said side edges and which are spaced from each other and from said rear broad surface, (b) a generally vertical tail portion of rigid sheet material having a front broad surface, a rear broad surface, a top edge, said tail portion being fixed to said head portion and overlapping said head portion so that the front broad surface of said head portion is forward of the front broad surface of said tail portion and the bottom edge of said head portion is below and forward of the top edge of said tail portion, and (c) releasable fastening means having two cooperating portions which are attached to said flanges for releasably attaching said brooch to the collar portion of a garmet for the upper part of the body.

2. Brooch as recited in claim 1, wherein said head portion is curved from one side edge to the other side edge so that the front broad surface of said head portion is convex, and wherein said tail portion has a pair of side edges and a portion of said tail portion which is adjacent said head portion is curved so that a portion of the front broad surface of said tail portion which is adjacent said head portion is convex.

3. Brooch as recited in claim 2, wherein said head portion has a greater radius of curvature than said tail portion so that the front broad surface of said tail portion engages the rear broad surface of said head portion at a midpoint between the side edges of said head portion and is spaced from the rear broad surface of said head portion on both sides of said midpoint.

4. Brooch as recited in claim 3, wherein the side edges of said tail portion are curved forwardly near said head portion so as to engage the rear broad surface of said head portion adjacent the side edges of said head portion.

5. Brooch as recited in claim 2, wherein the side edges of said head portion diverge from the bottom edge to the top edge of said head portion.

6. Brooch as recited in claim 1, wherein said tail portion has an aperture for receiving the pin portion of a standard tie tack.

7. Brooch simulating the appearance of a man's necktie comprising:

(a) a generally vertical head portion of rigid sheet material having a front broad surface, a rear broad surface, a top edge and a bottom edge, (b) a generally vertical tail portion of rigid sheet material having a front broad surface, a rear broad surface, a top edge said tail portion being fixed to said head portion so that the front broad surface of said head portion is forward of the front broad surface of said tail portion and the top edge of said tail portion is horizontally offset from the bottom edge of said head portion, (c) releasable fastening means connected to said head portion for releasably attaching said brooch to the collar of a shirt, and (d) a standard tie tack pin which is fixed to and extends rearwardly from said rear broad surface of said tail portion, said pin being adapted to operatively engage a complementary receiving clasp of a standard tie tack.

* * * * *

UNITED STATES PATENT AND TRADEMARK OFFICE

CERTIFICATE OF CORRECTION

PATENT NO. : 4,723,422

DATED : February 9, 1988

INVENTOR(S) : Elaine Foster

It is certified that error appears in the above-identified patent and that said Letters Patent are hereby corrected as shown below:

Column 1, line 61, change "one" to --on--.

Column 1, line 63, change "other" to --outer--.

Column 2, line 52, change "eth" to --etc.--.

Column 4, line 53, insert a comma after "edge".

Signed and Sealed this

First Day of November, 1988

*Attest:*

*Attesting Officer*

DONALD J. QUIGG

*Commissioner of Patents and Trademarks*